US005899675A

United States Patent [19]

Van Heumen et al.

[11] Patent Number: 5,899,675

[45] Date of Patent: May 4, 1999

[54] PUMP COMPRISING A CHAMBER WITH INLET AND OUTLET OPENINGS, A STEAM IRON COMPRISING SAID IRON AND A METHOD OF MANUFACTURING SAID PUMP

[75] Inventors: Emanuel L. G. M. Van Heumen; Johan F. Dijksman; Wilhelmus F. Zoetelief, all of Eindhoven, Netherlands

[73] Assignee: U.S. Philips Corporation, New York, N.Y.

[21] Appl. No.: 08/715,695

[22] Filed: Sep. 18, 1996

[30] Foreign Application Priority Data

Sep. 20, 1995 [EP] European Pat. Off. ..... 95202542

[51] Int. Cl.[6] ..... F04C 21/00

[52] U.S. Cl. ..... 417/482; 417/489; 417/497; 92/98 R; 418/50

[58] Field of Search ..... 418/49, 50; 417/481–484, 417/489, 472, 497; 92/98 R

[56] References Cited

U.S. PATENT DOCUMENTS

| | | | |
|---|---|---|---|
| 2,291,354 | 7/1942 | Sibley | 418/153 |
| 2,573,927 | 11/1951 | Orelind | 417/480 |
| 3,058,428 | 10/1962 | Gemeinhardt | 418/50 |
| 3,078,033 | 2/1963 | Ovrutsky | 417/489 |
| 3,922,119 | 11/1975 | Rosenquist | 418/45 |
| 4,042,309 | 8/1977 | Hiraga | 417/269 |
| 4,405,293 | 9/1983 | Pape | 417/482 |
| 4,540,352 | 9/1985 | Becker | 417/571 |

FOREIGN PATENT DOCUMENTS

| | | | |
|---|---|---|---|
| 1240741 | 3/1967 | Germany . | |
| 406317258 | 11/1994 | Japan | 417/472 |
| 568781 | 4/1945 | United Kingdom | 417/481 |

*Primary Examiner*—Charles G. Freay
*Attorney, Agent, or Firm*—Ernestine C. Bartlett

[57] ABSTRACT

A pump 1 comprises a chamber 2 having a inlet opening 22 and an outlet opening 21. The chamber 2 extends between a first main wall 30 and a second main wall 40. The first main wall 30 is a triangular bottom wall of a body 3. The second main wall 40 is a part of a triangular bottom wall of a tub 4. The body 3 is tiltable relative to the tub 4 so that the volume of the chamber 2 is variable. The pump 1 comprises an outlet valve for blocking the outlet opening 21 when the volume of the chamber 2 is increased and an inlet valve for blocking the inlet opening when the volume of the chamber 2 is reduced. The outlet valve is formed by a first portion 31 of the body 3. This first portion 31 of the body blocks the outlet opening when the body is urged against the outlet opening 21. The inlet valve is formed by a second portion 32 of the body 3. This second portion 32 of the body blocks the inlet opening when the body is urged against the outlet opening 21.

12 Claims, 6 Drawing Sheets

PUMP COMPRISING A CHAMBER WITH INLET AND OUTLET OPENINGS, A STEAM IRON COMPRISING SAID IRON AND A METHOD OF MANUFACTURING SAID PUMP

FIELD OF INVENTION

The invention relates to a pump comprising a chamber having an inlet opening and an outlet opening, the chamber extending between a first main wall and a second main wall, the first main wall being part of or connected to a body, the second main wall being part of or connected to a base, the body being movable relative to the base so that the volume of the chamber is variable, said pump comprising an inlet valve and an outlet valve for selectively blocking the inlet opening and the outlet opening, respectively.

The invention also relates to an iron comprising a reservoir connectable to a spray nozzle or a steam outlet via a pump.

The invention also relates to a method of manufacturing a pump.

BACKGROUND OF THE INVENTION

Such a pump is known from U.S. Pat. No. 4,042,309. In the known pump the base is formed as a cylinder and the body is formed as a piston which is movable along a straight line, thereby causing the volume of the chamber formed by the cylinder and the piston to increase and decrease. The pump further comprises a suction reed valve and a discharge reed valve to obtain a pumping effect when the volume of the chamber is repeatedly increased and reduced by movement of the piston. A disadvantage of the known pump is that it comprises many parts and that assembly of the pump is laborious.

SUMMARY OF THE INVENTION

It is an object of the invention to provide a pump which is easier to assemble. It is another object of the invention to provide a pump which is suited for mass production at low cost. To achieve this object, the pump according to the invention is characterized in that the outlet valve is formed by a first portion of the body, said first portion blocking the outlet opening when the body is urged against the outlet opening, the body being tiltable relative to the base about said first portion while the outlet opening remains blocked, the inlet valve is formed by a second portion of the body, said second portion blocking the inlet opening when the body is urged against the inlet opening, the body being tiltable relative to the base about said second portion while the inlet opening remains blocked.

Due to these measures the body is capable of performing a piston function and a valve function, as will be explained hereafter. In a first part of a pumping cycle, the body is tilted about the first portion from a first position, in which the first and second wall are positioned relatively close to each other, to a second position, in which the first and second wall are positioned relatively far from each other. This tilt produces a suction from the inlet opening to the pump chamber because the volume of the chamber increases while the outlet opening is blocked. In a second part of a pumping cycle the body is moved and/or tilted from the second position to a third position, in which the second portion blocks the inlet opening and the outlet opening is not blocked. In the third part of the pumping cycle the body is tilted about the second portion from the third position to the first position. During this third part of the pumping cycle at least part of the contents of the chamber is pressed into the outlet opening because the volume of the chamber decreases and the inlet opening is blocked. It is to be noted that blocking need not be complete in order to obtain a pumping effect. When the pressure difference between the inlet and the outlet is not too large, a partial closure of the openings will already result in a pumping effect because a relatively large opening allows the passage of more fluid (liquid or gas) than a small opening, even if the pressure difference across the small opening is larger than that across the large opening. Due to the combined function of the body, separate valves are not required so that the total number of parts is reduced considerably and assembly of the pump is easier. Moreover, since valves usually comprise small and accurate parts, which are costly and difficult to handle, mass production is simplified.

An embodiment of the pump in accordance with the invention is characterized in that said first portion and said second portion of the body have rounded corners. Use of the rounded corners enables a more effective blocking of the corresponding opening while the body is tilted about one of said portions.

An embodiment of the pump in accordance with the invention is characterized in that the base and/or the body comprise a resilient material. This measure results in a silent operation of the pump, even when the pump runs dry. This is especially important for a consumer product such as an iron. When rigid materials for the body and the base are used, leaking of the chamber through one of the openings or through the interface between the body and the base will readily occur. The use of an elastic material makes it possible to block an opening and to obtain a sealing between the body and the base while allowing for tilt of the body and production tolerances in the dimensions of the parts. A flexible material allows the body and/or the base to deform slightly during tilting and this deformation produces a force which keeps the walls of the body and the base in contact, which precludes leaking. It has been found that a base of a silicone elastomer provides a satisfactory sealing so that the pump is capable of generating a pressure of up to 1 bar when pumping water.

An embodiment of the pump in accordance with the invention is characterized in that said first main wall and said second main wall are polygonal and that the inlet opening and the outlet opening are located at two adjacent corners. Due to this measure the outlet opening and the inlet opening can be blocked simultaneously during the transition from the first part of the pumping cycle to the second part, so that it is possible to prevent that both openings from being unblocked at the same time. Such a simultaneous unblocking may cause a reverse flow from the outlet to the inlet opening because since the pressure at the outlet opening is usually higher than the pressure at the inlet opening due to the pumping action. It will be clear that such a reverse flow is undesirable since it counteracts the pump action.

An embodiment of the pump in accordance with the invention is characterized in that said first main wall and said second main wall have a triangular shape, and the base comprises trapezoid shaped side walls which enclose an acute angle with the second main wall such that a sealing between the base and the body is maintained during tilting of the body.

It has been found that said shape enables an efficient pumping action to be obtained and that the inclined side walls provide an improved sealing of the chamber due to an increase of the contact pressure between the base and the body side walls when the body is tilted.

An embodiment of the pump in accordance with the invention is characterized in that said first main wall and said second main wall have matching surfaces and in that the pump comprises urging means to press the first main wall and the second main wall against each other over substantially their whole area. Due to these measures the volume of the chamber will be virtually zero when the pump is not activated. The advantage of this embodiment is that the pump is self-priming and self-cleaning because no fluid remains in the pump chamber. For example, when water is pumped, these measures can prevent scale deposit on the walls of the chamber when the pump is stored for a long time.

An embodiment of the pump in accordance with the invention is characterized in that the body and the base are interconnected by means of a flexible membrane. This measure prevents leaking through the interface between the body and the base.

An embodiment of the pump in accordance with the invention is characterized in that the pump comprises drive means to drive a portion of the body which is remote from said first main wall along a closed-loop curve situated in a plane which is perpendicular to the normal to the centre of said second main wall. As the body side walls are positioned by the base, driving the portion of the body which is remote from said first wall in accordance with said loop will cause the body to be fitted successively about its first and second portion. In this way the tilting of the body required to obtain the pumping action can be generated with simple means, for example by driving said remote portion along a circular loop with a rotation motor.

An embodiment of the pump in accordance with the invention is characterized in that the drive means comprise at least two linear actuators which are oriented in different directions. By driving the actuators with a phase difference the body can be tilted about its first and second portions. Such actuators can, for example, be electromagnetic or piezoelectric actuators, so that a robust and small electric pump is realized.

The iron according to the invention comprises a reservoir connectable to a spray nozzle or a steam outlet via a pump according to the invention. The pump according to the invention is especially suited for use in an iron, because it can be manufactured at low cost, it can build up sufficient pressure for the spray function, it is silent, it is self-priming, so that the user has no problem when the pump runs dry, and it is self-cleaning, so that no scale deposit occurs in the pump, which precludes malfunctioning.

The method in accordance with the invention is characterized in that the body is positioned relative to a support part, the support part surrounding the end of the body near its main wall with clearance, and the base is formed by molding a resilient material between the body and the support part. By using the method according to the invention, assembly of the pump is reduced to a minimum number of steps and a good fit of the body and the base is ensured, which precludes leaking of the pump.

DETAILED DESCRIPTION OF THE DRAWINGS

The invention will now be described in greater detail with reference to the figures of the drawings.

Figure 1:
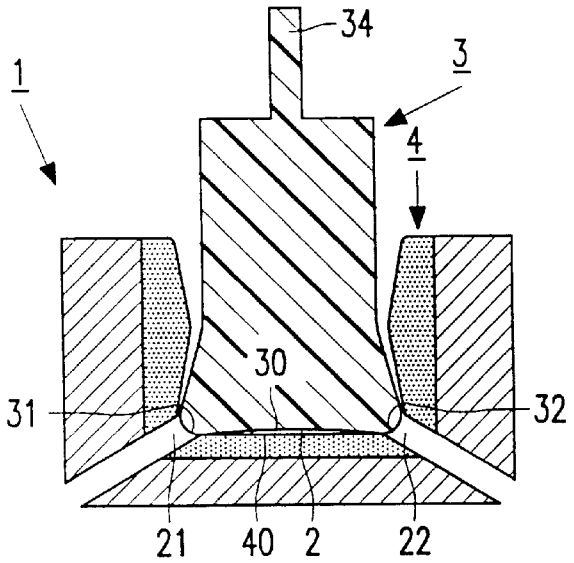
FIG. 1 shows a cross-sectional view of a first embodiment of a pump according to the invention with its body is in a first position.

FIG. 1 is a cross-sectional view of a pump 1 according to the invention. The pump 1 comprises a chamber 2 (see FIG. 2) having a inlet opening 22 and an outlet opening 21. The chamber 2 extends between a first main wall 30 and a second main wall 40. The first main wall 30 is a part, in this case a triangular bottom wall, of a body 3. The second main wall 40 is a part of a base, in this case a triangular bottom wall of a tub 4. The body 3 is movable relative to the tub 4 so that the volume of the chamber 2 is variable. In FIG. 1 the body 3 is shown in a first position, in which the volume of the chamber 2 is minimal. The pump 1 comprises an outlet valve for blocking the outlet opening 21 when the volume of the chamber 2 is increased and an inlet valve for blocking the inlet opening when the volume of the chamber 2 is reduced. The outlet valve is formed by a first portion 31 of the body 3. This first portion 31 of the body blocks the outlet opening when the body is urged against the outlet opening 21. The inlet valve is formed by a second portion 32 of the body 3. This second portion 32 of the body blocks the inlet opening when the body is urged against the outlet opening 21. In the first position of the body as shown in FIG. 1 both the outlet opening 21 and the inlet opening 22 are blocked.

Figure 2:
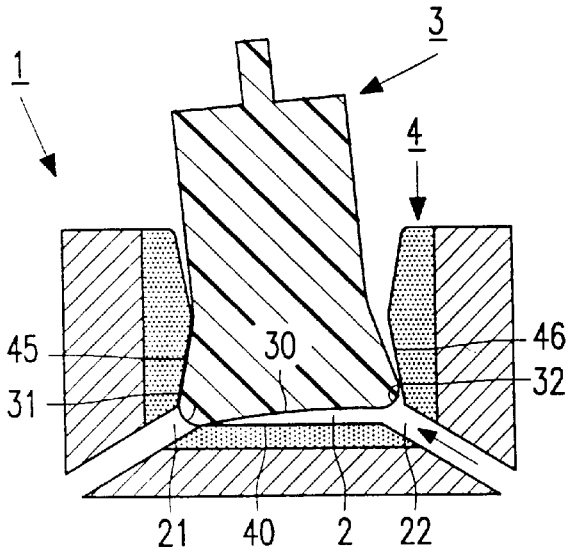
FIG. 2 shows the pump of FIG. 1 in a situation in which the body has been tilted to a second position.

FIG. 2 shows the pump of FIG. 1 in a situation in which the body 3 has been tilted relative to the tub 4 about the first portion 31 of the body into a second position. The outlet opening 21 remains blocked by the first portion 31 of the body 3 in the second position of the body and during tilting from the first position of the body, as shown in FIG. 1, to the second position of the body 3, as shown in FIG. 2. Due to said tilting the second portion 32 is moved away from the inlet opening 22 and the inlet opening 22 is unblocked. Said tilting also causes the volume of the chamber 2 to increase. The body 3 fits tightly in the tub 4, so that the chamber is sealed at the interface between the body 3 and the tub 4. Hence, said increase of the volume of the chamber 2 will cause a suction from the inlet opening 22 to the chamber 2. In this case, said first portion 31 and said second portion 32 each comprise a segment of a sphere i.e. have rounded corners, to enable a good sealing of the outlet opening 21 and the inlet opening 22 when the body is tilted about one of said portions. The tub 4 is made of a resilient material to improve the sealing of the interface between the body 3 and the tub 4 and the sealing of the outlet opening 21 and the inlet opening 22 by the first portion 31 and second portion 32 of the body 3, respectively. The tub 4 has trapezoid side walls 45 and 46, which enclose an acute angle with the bottom wall 40 of the tub 4. When the body 3 is tilted, the body 3 is pressed slightly into the resilient material so that the contact pressure between the surfaces of the body 3 and the tub 4 is increased, which improves the resistance to leakage due to a pressure difference between the inside of the chamber 2 and its surroundings. Additionally, lifting of the body 3 is prevented by the side walls 45 and 46, so that the outlet opening 21 remains closed when pressure builds up in chamber 2.

Figure 3:
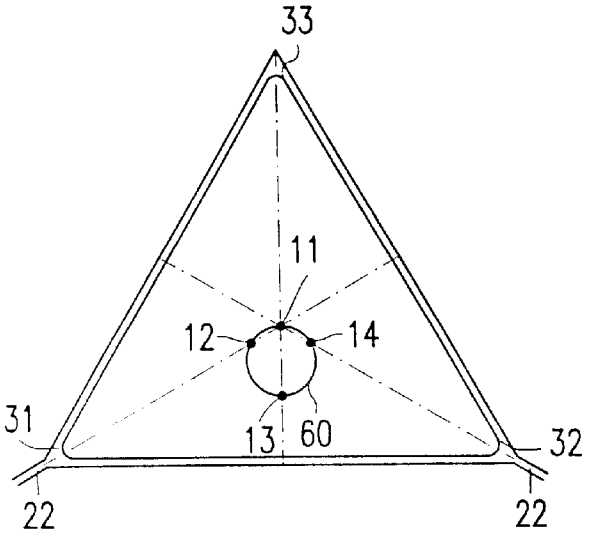
FIG. 3 is a schematic plan view of the pump of FIGS. 1 and 2.

FIG. 3 is a schematic plan view of the pump of FIGS. 1 and 2. The closed-loop curve 60 is an example of a path which may be followed by a portion 34 (see FIG. 1) of the body 3 that is remote from the bottom wall 30 of the body during activation of the pump. The closed-loop curve 60 lies in a plane which is perpendicular to the normal 43 (see FIG. 4) to the center of said second main wall 40. The first position of the body 3 as shown in FIG. 1 corresponds to the reference numeral 11, the second position of the body 3 as shown in FIG. 2 corresponds to the reference numeral 12, a third position of the body 3 as shown in FIG. 4 corresponds to the reference numeral 13, and a fourth position of the body as shown in FIG. 5 corresponds to the reference numeral 14.

Figure 4:
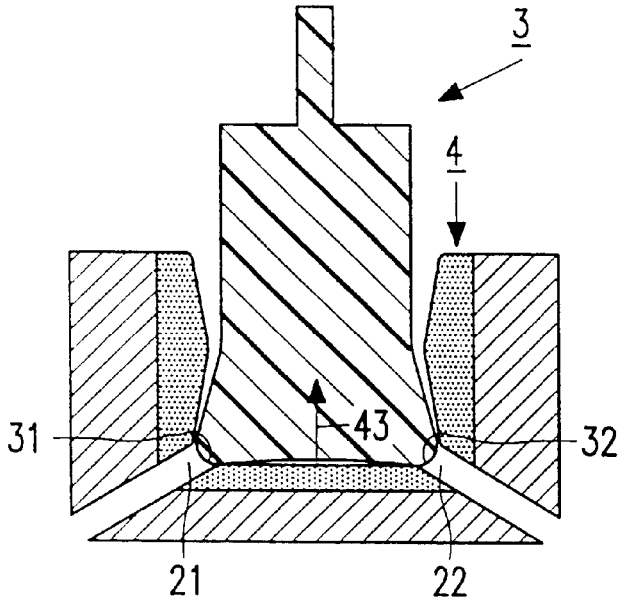
FIG. 4 shows the pump of FIGS. 1 and 2 in a situation in which the body has been tilted to a third position.

FIG. 4 shows the pump of FIGS. 1 and 2 in the situation that the body has been tilted to the third position as indicated by the reference numeral 13 in FIG. 3. In this third position the body has been tilted in a direction perpendicular to the plane of the drawing relative to the first position. Although this is not visible in FIG. 4, the first main wall and the second main wall are remote from each other in a similar way as shown in FIG. 2. In the third position both the outlet opening 21 and the inlet opening 22 are blocked by said first portion 31 and said second portion 32 of the body 3, respectively.

Figure 5:
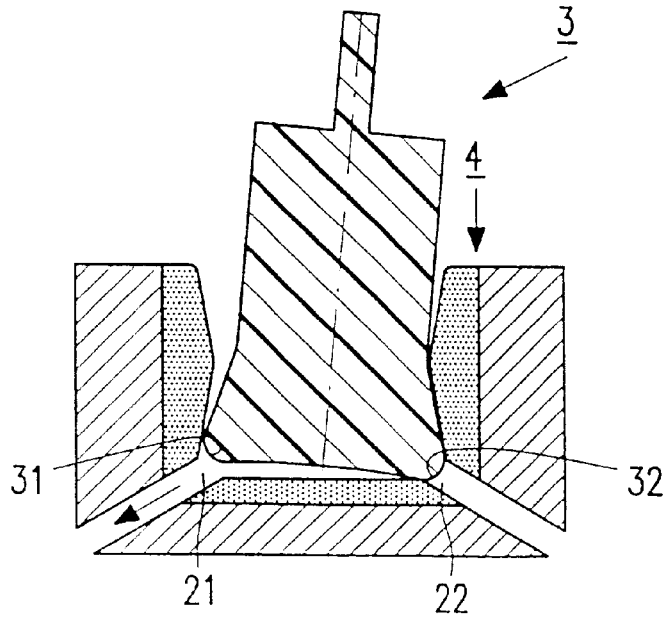
FIG. 5 shows the pump of FIGS. 1, 2 and 4 in a situation in which the body has been tilted to a fourth position.

FIG. 5 shows the pump of FIGS. 1, 2 and 4 in the situation that the body has been tilted to the fourth position as indicated by the reference numeral 14 in FIG. 3. The inlet opening 22 remains blocked by the second portion 32 of the body 3 in the fourth position of the body and during tilting from the third position of the body, as shown in FIG. 4, to the fourth position of the body 3, as shown in FIG. 5. Due to said tilting, the first portion 31 is moved away from the outlet opening 21, so that the outlet opening 21 is unblocked.

During the last part of a pumping cycle, the body 3 is tilted from the fourth position, as shown in FIG. 5, to the first position, as shown in FIG. 1. The inlet opening 22 remains blocked by the second portion 32 of the body 3 in the fourth position of the body 3 and during tilting from the fourth position of the body, as shown in FIG. 5, to the first position of the body 3, as shown in FIG. 1. Said tilting causes the volume of the chamber 2 to decrease. As already stated, the body 3 fits tightly in the tub 4, so that the chamber is sealed at the interface between the body 3 and the tub 4. Hence, said decrease of the volume of the chamber 2 will cause a displacement of the contents of the chamber 2 through the outlet opening 21.

Figure 6:
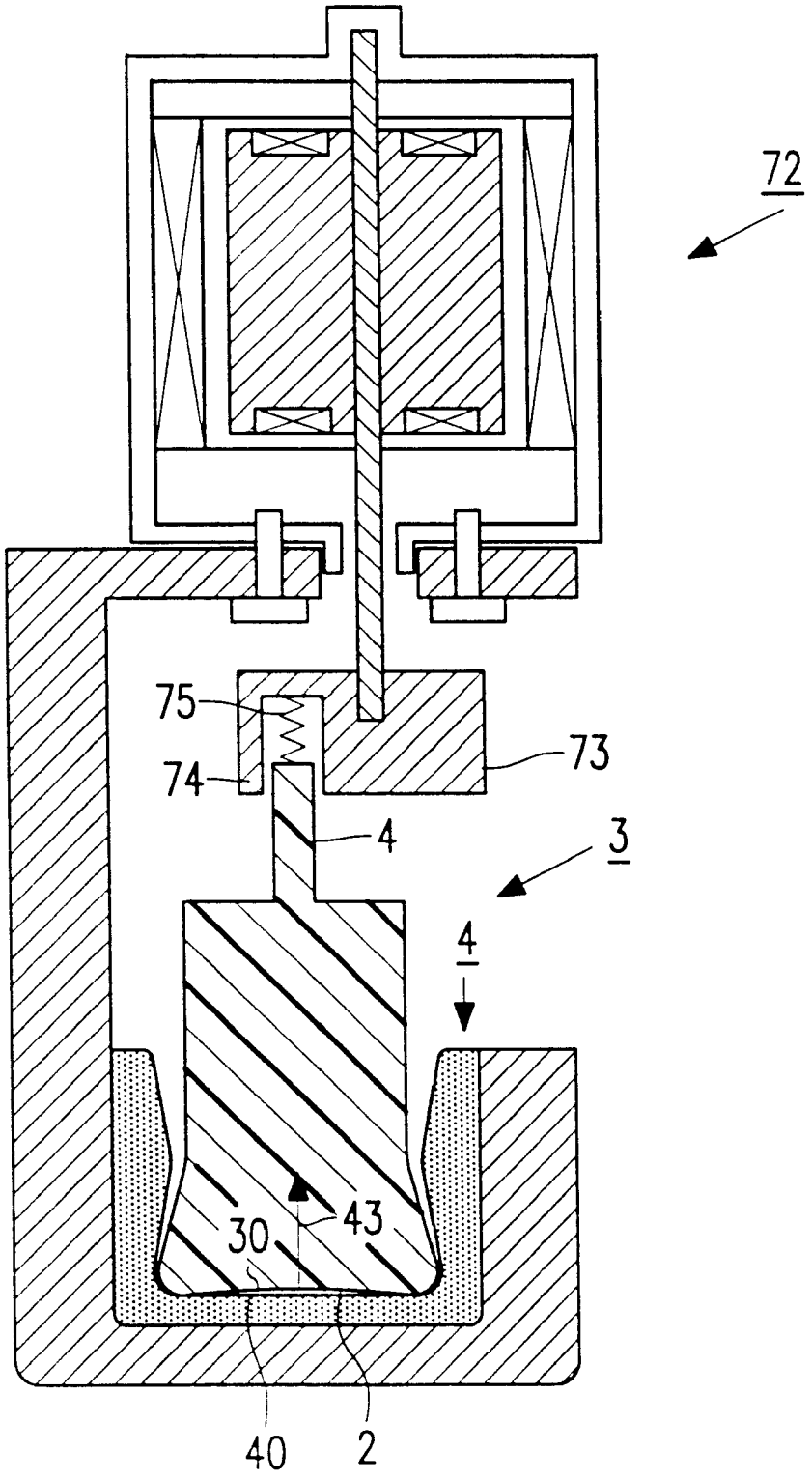
FIG. 6 is a cross-sectional view of a pump is shown in FIGS. 1 to 5 and drive means for driving the pump.

FIG. 6 shows a pump in accordance with FIGS. 1 to 5 and drive means for driving the pump in a cross-sectional view taken perpendicularly to the cross-sectional view of FIG. 1. To drive the pump, the body 3 is tilted by driving a portion 43 of the body remote from the bottom wall 30 of the body. This remote portion 43 can be driven along a circular closed-loop curve 60, as shown in FIG. 3, by means of a rotary motor 72 and a disc 73 with an eccentric hole 74. The circular closed loop curve 60 lies in a plane which is perpendicular to the normal 43 to the center of said second main wall 40. The bottom wall 30 of the body 3 and the bottom wall 40 of the tub 4 have matching surfaces and the pump comprises urging means in the form of a spring 75 to press the walls 30 and 40 of the body and the tub against each other over their whole area. In this way the volume of the chamber 2 is almost zero when the body is in its first position. The advantage is that the pump is self-priming and self-cleaning because no fluid remains in the pump chamber 2.

Figure 7:
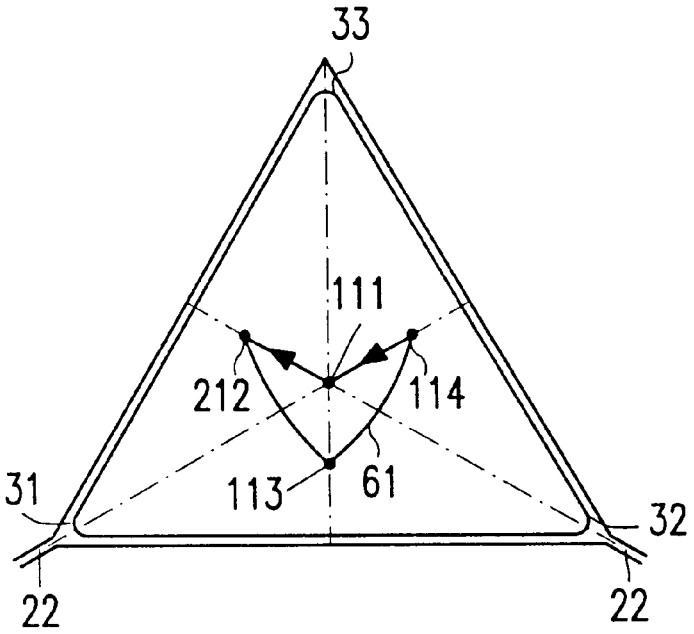
FIG. 7 is another schematic plan view of the pump of FIGS. 1, 2, 4 and 5.

FIG. 7 shows another schematic plan view of the pump of FIGS. 1, 2, 4 and 5. The closed-loop curve 61 is another example of a path which may be followed by the portion 34 (see FIG. 6) of the body 3 that is remote from the bottom wall 30 of the body 3 during activation of the pump. The closed-loop curve 61 also lies in a plane which is perpendicular to the normal 43 (see FIG. 6) to the center of said second main wall 40. The first position of the body 3 as shown in FIG. 1 corresponds to the reference numeral 111, the second position of the body 3 as shown in FIG. 2 corresponds to the reference numeral 112, the third position of the body 3 as shown in FIG. 4 corresponds to the reference numeral 113, and the fourth position of the body as shown in FIG. 5 corresponds to the reference numeral 114.

Figure 8:
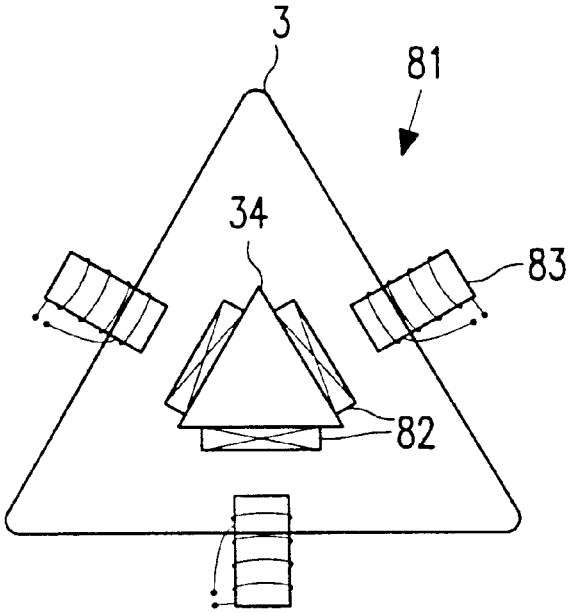
FIG. 8 is a plan view of a body for a pump as shown in FIG. 1 and other drive means for driving the pump

FIG. 8 is a plan view of a body 3 for a pump as shown in FIG. 1 and of other drive means for driving the pump. To drive the pump, the body 3 is again tilted by driving the portion 34 of the body that is remote from the bottom wall of the body. The remote portion 34 can be driven along a closed loop 61, as shown in FIG. 7, by means of three linear actuators 81 spaced at angles of 120 degrees from one another. Each actuator 81 comprises a permanent magnet 82 and an electromagnet 83. With these actuators the remote portion 34 can also be driven along the circular loop 60 as shown in FIG. 3. In fact, two linear actuators 81 oriented in different directions in a plane substantially parallel to the bottom wall 30 of the body 3 are sufficient to drive said remote portion 34 along said circular loop 60 (see FIG. 3) or said closed loop 61 (see FIG. 7).

Figure 9:
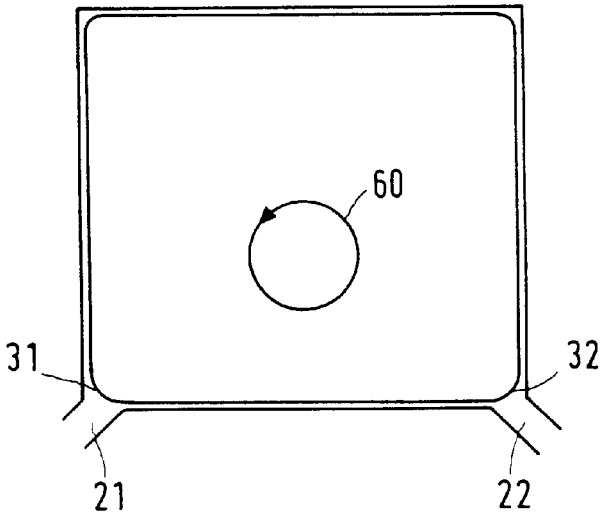
FIG. 9 is a view similar to that of FIG. 3, showing a second embodiment of the pump according to the invention.

FIG. 9 is a view similar to that of FIG. 3 and shows an embodiment in which the first main wall and the second main wall have a quadrangular shape. A quadrangular shape is easier to manufacture than a triangular shape as shown in FIG. 3. The outlet opening 21 and the inlet opening 22 are located at two adjacent corners, so that when the pump is driven along the circular loop 60. FIGS. 1, 2, 4 and 5 also apply to this quadrangular embodiment and the outlet opening 21 and the inlet opening 22 are prevented from being unblocked at the same time. Such a simultaneous unblocking would occur when the outlet opening 21 and the inlet opening 22 would be positioned at opposite corners. This would cause a reverse flow from the outlet opening 21 to the inlet opening 22 because the pressure at the outlet opening 21 is usually higher than the pressure at the inlet opening 22 due to the pumping action. It will be obvious that such a reverse flow is undesirable since it counteracts the pump action.

Figure 10:
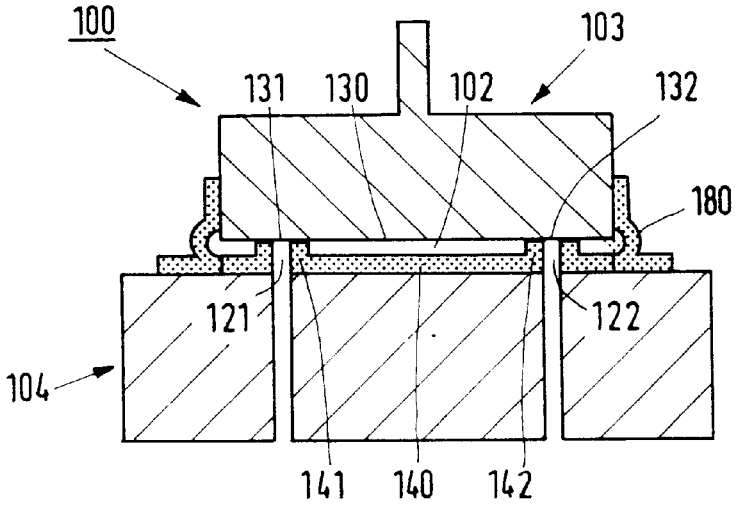
FIG. 10 is a cross-sectional view of a third embodiment of the pump according to the invention.

FIG. 10 is a cross-sectional view of another embodiment 100 of the pump according to the invention. The pump 100 comprises a chamber 102 having a inlet opening 122 and an outlet opening 121. The chamber 102 extends between a first main wall 130 and a second main wall 140. The first main wall 130 is a bottom wall of a body 103. The second main wall 140 is part of a base 104. The body 103 is movable relative to the base 104 so that the volume of the chamber 102 is variable. In FIG. 10 the body 103 is shown in a first position, in which the volume of the chamber 102 is minimal. The pump 100 comprises an outlet valve for blocking the outlet opening 121 when the volume of the chamber 102 is increased and an inlet valve for blocking the inlet opening 122 when the volume of the chamber 102 is reduced. The outlet valve is formed by a first portion 131 of the body 103. This first portion 131 of the body blocks the outlet opening 121 when the body is urged against the outlet opening 121. The inlet valve is formed by a second portion 132 of the body 103. This second portion 132 of the body blocks the inlet opening 122 when the body is urged against the inlet opening 122. In the first position of the body as shown in FIG. 10 both the outlet opening 121 and the inlet opening 122 are blocked.

Figure 11:
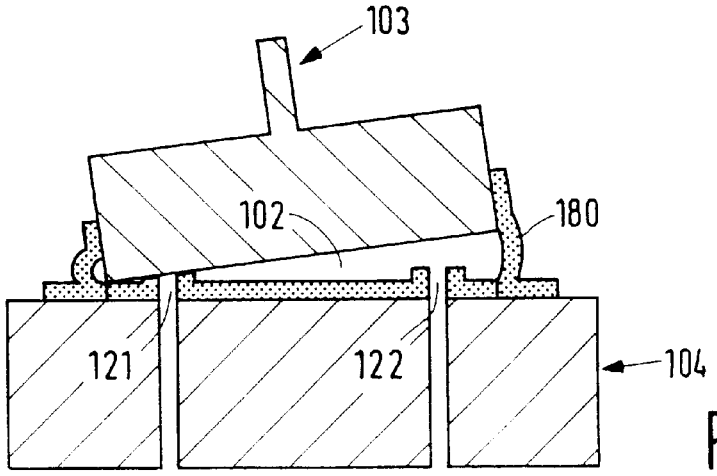
FIG. 11 shows the pump of FIG. 10 in a situation in which the body has been tilted to a second position.

FIG. 11 shows the pump of FIG. 10 in a situation in which the body 103 has been tilted relative to the base 104 about the first portion 131 of the body into a second position. The portions 141 and 142 of the base in which the outlet opening 121 and the inlet opening 122 are formed protrude into the chamber and are made of a resilient material. Due to these measures the outlet opening 121 remains blocked by the first portion 131 of the body 103 in the second position of the body and during tilting from the first position of the body, as shown in FIG. 10, to the second position of the body 103, as shown in FIG. 11. Due to said tilting, the second portion 132 is moved away from the inlet opening 122 and the inlet opening 122 is unblocked. Said tilting also causes the volume of the chamber 102 to increase. The body 103 and the base 104 are interconnected by means of a flexible membrane 180, so that the chamber is sealed at the interface between the body 103 and the base 104. Hence, said increase of the volume of the chamber 102 will cause a suction from the inlet opening 122 to the chamber 2. Alternatively, said first portion 131 and said second portion 132 comprise a segment of a sphere have rounded corners to enable a proper sealing of the outlet opening 121 and the inlet opening 122 when the body is tilted about one of said portions. Operation of this embodiment is similar to that of the pump shown in FIGS. 1 to 9.

Figure 12:
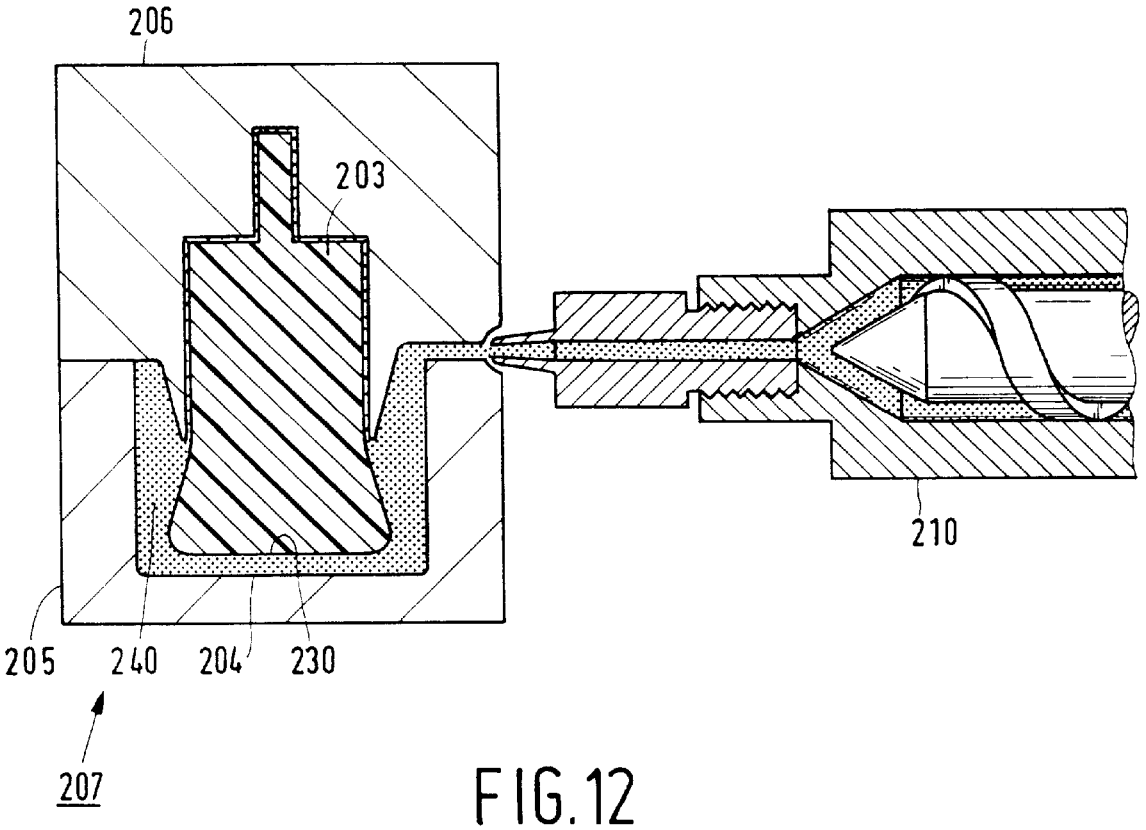
FIG. 12 shows an arrangement for manufacturing a pump according to the invention.

FIG. 12 shows a set-up for manufacturing a pump according to the invention. A body 203 is positioned by an upper mold part 206, which forms a mould 207 together with a support part 205. The body 203 is so positioned relative to the support part 205 that the support part surrounds the end of the body near its first main wall 230 with a clearance, so that a space 240 is formed between the body and the support part. With an extruder 210 a resilient material, for example a thermoplastic elastomer, is pressed into the space 240 between the body 203 and the support part 205 to form a base or tub 204 in accordance with the above description. An inlet opening and an outlet opening may be formed during molding or afterwards. The upper mold 206 is removed after the resilient material has been allowed to cure. In this way a pump is manufactured wherein the body 203 fits perfectly in the tub 204, so that a proper sealing is obtained.

Figure 13:
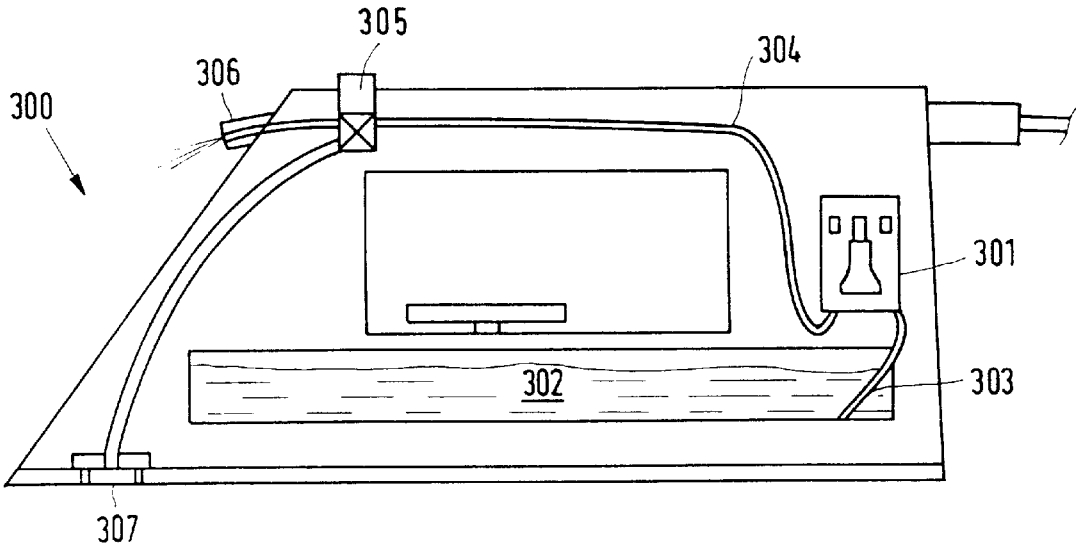
FIG. 13 shows an iron according to the invention.

FIG. 13 shows an iron 300 comprising a pump according to the invention. The iron 300 comprises a water reservoir 302 from which a tube 303 leads to the inlet opening of the pump 301. From the outlet opening of the pump 301 a tube 304 leads to a two-way valve 305 for distribution of water to a spray nozzle 306 or a steam outlet 307. The pump 301 according to the invention is especially suited for use in an iron 300 because it can be manufactured at low cost, it can build up sufficient pressure for the spray function, it is self-priming, so that the user has no problem when the pump runs dry, and it is self-cleaning, so that no scale deposit occurs in the pump, which precludes malfunctioning.

Hereinbefore the invention has been described for embodiments in which the body is actuated. However, it is to be noted that alternatively the support part may be actuated. Other embodiments may comprise transmission means to convert a linear movement into a rotational movement to drive the body, so that the pump can be operated by manual force. Further it is to be noted that in the embodiments shown, the pump is symmetrical, so that the direction of fluid transport can be reversed by simply changing the direction in which the closed-loop curves 60 and 61 are followed. As a result of this reversal the functions of the inlet opening and the outlet opening will be interchanged.

We claim:

1. A pump (1;100) comprising a chamber having an inlet opening and an outlet opening, the chamber extending between a first main wall and a second main wall, the first main wall being part of a body, the second main wall being part of or connected to a base, the body being movable relative to the base so that the volume of the chamber is variable, said pump comprising an inlet valve and an outlet valve for selectively blocking the inlet opening and the outlet opening, respectively, wherein the outlet valve is formed by a first portion of the body, said first portion blocking the outlet opening when the body is urged against the outlet opening, the body being tiltable relative to the base about said first portion while the outlet opening remains blocked, the inlet valve is formed by a second portion of the body, said second portion blocking the inlet opening when the body is urged against the inlet opening, the body being tiltable relative to the base about second portion while the inlet opening remains blocked.

2. An iron comprising a reservoir, a pump as claimed in claim 1, a spray nozzle and a steam nozzle, said reservoir being connectable to one of said spray nozzle and said steam outlet via said pump.

3. A pump as claimed in claim 1 wherein at least one of the base and the body comprise a resilient material.

4. A pump as claimed in claim 1, characterized in that said first portion and said second portion of the body (3; 103) comprise rounded corners.

5. A pump as claimed in claim 1 said first main wall and said second main wall are polygonal and that the inlet opening and the outlet opening are located at two adjacent corners.

6. A pump as claimed in claim 5, wherein said first main wall (30) and said second main wall (40) have a triangular shape, and the base (4) comprises trapezoid shaped side walls (45, 46) which enclose an acute angle with the second main wall such that a sealing between the base and the body (3) is maintained during tilting of the body.

7. A pump as claimed in claim 3, wherein said first main wall and said second main wall have a triangular shape, and the base comprises trapezoid shaped side walls which enclose an acute angle with the second main wall such that a sealing between the base and the body is maintained during tilting of the body.

8. A pump as claimed in claim 1 said first main wall and said second main wall have matching surfaces and in that the pump comprises urging means to press the first main wall and the second main wall against each other over substantially their whole area.

9. A pump as claimed in claim 1 the body and the base are interconnected by means of a flexible membrane.

10. A pump as claimed in claim 1 the pump comprises drive means to drive a portion of the body which is remote from said first main wall along to a closed loop curve situated in a plane which is perpendicular to the normal to the center of said second main wall.

11. A pump as claimed in claim 10, characterized in that the drive means comprise at least two linear actuators which are oriented in different directions.

12. Method of manufacturing a pump as claimed in claim 1, herein, the body is positioned relative to a support part, the support part surrounding the end of the body near its first main wall with clearance, and the base is formed by molding a resilient material between the body and the support part.

* * * * *